US007621028B2

(12) United States Patent
Gelly et al.

(10) Patent No.: US 7,621,028 B2
(45) Date of Patent: Nov. 24, 2009

(54) METHOD FOR OPTIMIZED DEMATCHING LAYER ASSEMBLY IN AN ULTRASOUND TRANSDUCER

(75) Inventors: Jean-Francois Gelly, Mougins (FR); David Martin Mills, Niskayuna, NY (US); Frederic Lanteri, Le Cannet (FR); Charles Edward Baumgartner, Niskayuna, NY (US); Serge Gerard Calisti, Bouches du Rhone (FR)

(73) Assignee: General Electric Company, Schenectady, NY (US)

( * ) Notice: Subject to any disclaimer, the term of this patent is extended or adjusted under 35 U.S.C. 154(b) by 2 days.

(21) Appl. No.: 11/900,699

(22) Filed: Sep. 13, 2007

(65) Prior Publication Data

US 2009/0072668 A1 Mar. 19, 2009

(51) Int. Cl.
*H04R 17/10* (2006.01)

(52) U.S. Cl. ..... 29/25.35; 29/594; 29/593; 310/311; 310/313 R; 310/334; 324/727

(58) Field of Classification Search ..... 29/25.35, 29/594, 593; 310/311, 313 R, 313 A, 322, 310/334; 324/727

See application file for complete search history.

(56) References Cited

U.S. PATENT DOCUMENTS

| | | | | |
|---|---|---|---|---|
| 4,296,349 | A | 10/1981 | Nakanishi et al. | |
| 4,915,115 | A | 4/1990 | Sasaki et al. | |
| 5,267,221 | A | 11/1993 | Miller et al. | |
| 6,308,389 | B1 * | 10/2001 | Tezuka | 29/25.35 |
| 6,467,138 | B1 | 10/2002 | Aime | |
| 6,475,151 | B2 | 11/2002 | Koger et al. | |
| 6,514,618 | B1 | 2/2003 | McKeighten | |
| 6,551,248 | B2 | 4/2003 | Miller | |
| 6,685,647 | B2 | 2/2004 | Savord et al. | |
| 6,936,008 | B2 | 8/2005 | Tarakci et al. | |

FOREIGN PATENT DOCUMENTS

JP 58006462 A * 1/1983

OTHER PUBLICATIONS

Goldberg et al, "Modeling of Piezoelectric Multilayer Ceramics Using Finite Element Analysis", IEEE Transactions on Ultrasonics, Ferroelectrics, and Frequency Control, vol. 44, No. 6, Nov. 1997, pp. 1204-1214.*

Ehrard K. Sittig, Effects of Bonding and Electrode Layers on the Transmission Parameters of Piezoelectric Transducers Used in Ultrasonic Digital Delay Lines, IEEE Transactions on Sonics and Ultrasonics, vol. SU-16, No. 1, Jan. 1969.

* cited by examiner

*Primary Examiner*—A. Dexter Tugbang
(74) *Attorney, Agent, or Firm*—The Small Patent Law Group; Dean D. Small

(57) ABSTRACT

A method for manufacturing an acoustical stack for use within an ultrasound transducer comprises using a user defined center operating frequency of an ultrasound transducer that is at least about 2.9 MHz. A piezoelectric material and a dematching material are joined with an assembly material to form an acoustical connection therebetween. The piezoelectric material has a first acoustical impedance and *at least one of* an associated piezoelectric rugosity (Ra) and piezoelectric waviness (Wa). The dematching material has a second acoustical impedance that is different than the first acoustical impedance and at least one of an associated dematching Ra and dematching Wa. The piezoelectric and dematching materials have an impedance ratio of at least 2. The assembly material has a thickness that is based on the center operating frequency and at least one of the piezoelectric Ra, piezoelectric Wa, dematching Ra and dematching Wa.

16 Claims, 10 Drawing Sheets

| | | | | |
|---|---|---|---|---|
| Density | ρc | ρ assy | ρ dml | ρ B |
| Sound Celerity | cc | c assy | c dml | c B |
| Thickness | ℓc | ℓassy | ℓ dml | ℓB |
| Acoustical Impedance | ZC | Z assy | Z dml | Z B |

220

METHOD FOR OPTIMIZED DEMATCHING LAYER ASSEMBLY IN AN ULTRASOUND TRANSDUCER

BACKGROUND OF THE INVENTION

This invention relates generally to ultrasound transducers, and more particularly, to acoustical stacks that are within the ultrasound transducers.

Ultrasound transducers (also commonly referred to as probes) typically have many acoustical stacks arranged in one dimension or in two-dimensional (2D) arrays. Each acoustical stack corresponds to an element within the transducer, and a transducer may have many acoustical stacks therein, such as several thousand arranged in the 2D array. A known problem in ultrasound transducers using standard half wavelength thickness (λ/2) ceramic piezoelectric materials within the acoustical stack is the perturbation from the back of the acoustical stack, such as radiation losses, parasitic reflections and the like. To address this problem, a quarter wavelength thickness (λ/4) piezoelectric material has been used and is coupled with a high impedance layer that is positioned at the rear-facing part of the piezoelectric material. The high impedance layer is often referred to as a "dematching layer". This arrangement induces a decrease in insertion losses in the 1 to 3 dB range, and also induces an 8 to 10 percent bandwidth (BW) increase (the rear "blocking" condition is similar to a symmetrical loading of the piezoelectric material, resulting in a lower mechanical Q). These advantages are coupled with a reduction of the input impedance of the transducer in the magnitude of 50 percent. In other transducers, a high impedance backing layer has also been used with a polyvinylidene fluoride (PVDF) piezoelectric material in order to decrease insertion losses and increase BW.

Unfortunately, problems occur when the transducers are used at some frequencies. For example, when the transducers are operating at frequencies above 5 MHz, the ceramic and dematching layer substrate properties and the joining material there-between together severely limit the mechanical action of the dematching layer. Also, the theoretical prediction of the expected performance enhancement resulting from the addition of the dematching layer is based upon the acoustical and mechanical properties of the two materials, and assumes a direct contact there-between across the surfaces of the dematching and ceramic layers. However, it has been very difficult to ensure direct contact between the dematching and ceramic layers, leading to rejection of assembled materials due to unacceptable performance.

Therefore, a need exists for improved acoustical stacks used within ultrasound transducers.

BRIEF DESCRIPTION OF THE INVENTION

In one embodiment, a method for manufacturing an acoustical stack for use within an ultrasound transducer comprises using a user defined center operating frequency of an ultrasound transducer that is at least about 2.9 MHz. A piezoelectric material and a dematching material are joined with an assembly material to form an acoustical connection there-between. The piezoelectric material has a first acoustical impedance and at least one of an associated piezoelectric rugosity (Ra) and piezoelectric waviness (Wa). The dematching material has a second acoustical impedance that is different than the first acoustical impedance and at least one of an associated dematching Ra and dematching Wa. The piezoelectric and dematching materials have an impedance ratio of at least 2. The assembly material has a thickness that is based on the center operating frequency and at least one of the piezoelectric Ra, piezoelectric Wa, dematching Ra and dematching Wa.

In another embodiment, an acoustical stack for use within an ultrasound transducer comprises a piezoelectric layer having top and bottom sides. The bottom side of the piezoelectric layer has at least one of an associated piezoelectric Wa and piezoelectric Ra. A dematching layer has top and bottom sides and the top side is configured to be attached to the bottom side of the piezoelectric layer. The top side of the dematching layer has at least one of an associated dematching Wa and dematching Ra. An assembly material is applied between the bottom side of the piezoelectric layer and the top side of the dematching layer. The assembly material has a thickness based on at least one of the piezoelectric Wa, the piezoelectric Ra, the dematching Wa and the dematching Ra.

In yet another embodiment, a method for joining layers of an acoustical stack used within an ultrasound transducer to form an acoustical connection there-between comprises using a piezoelectric material and a dematching material wherein an impedance ratio between the piezoelectric and dematching materials is at least 2. An assembly material is used that is one of a metallic material, a metallic-based material, a compound having at least one metallic material, an organic material and an organic compound. The piezoelectric and dematching materials are joined with the assembly material.

DETAILED DESCRIPTION OF THE INVENTION

Figure 1:
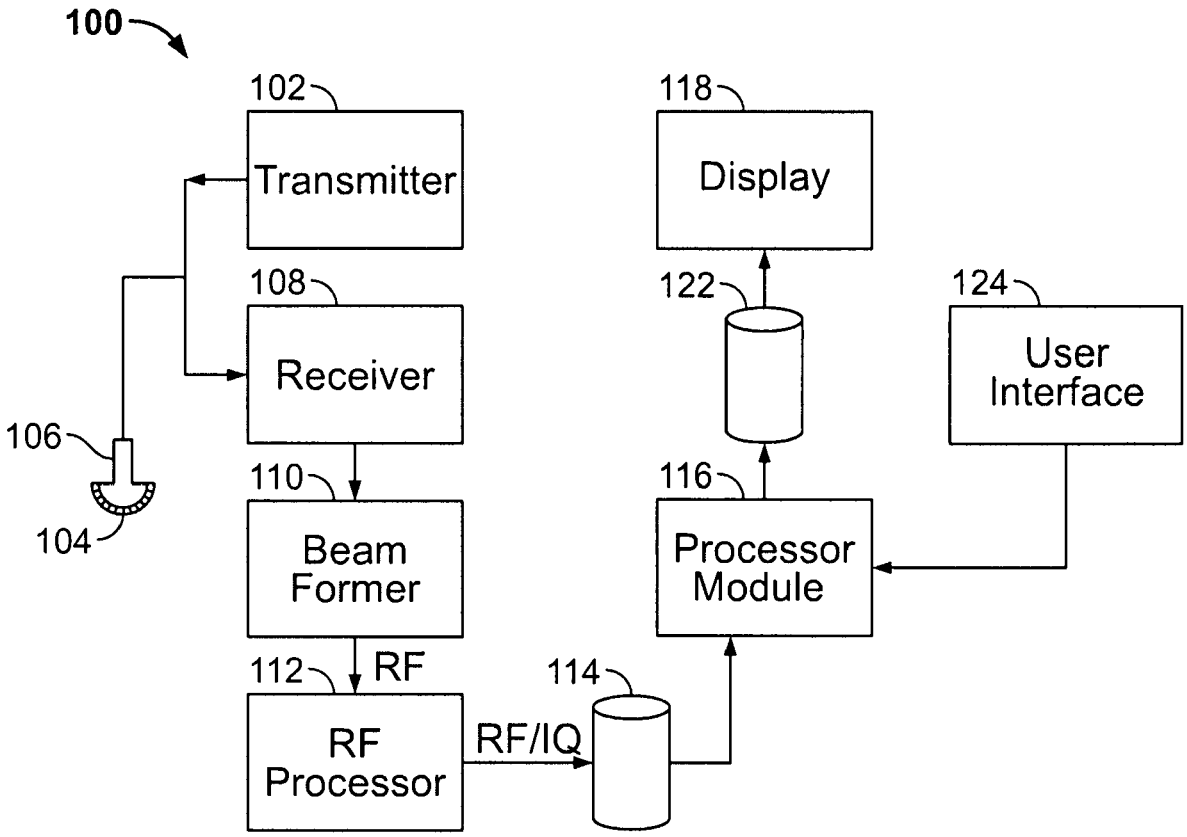
FIG. 1 illustrates a block diagram of an ultrasound system.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or random access memory, hard disk, or the like). Similarly, the programs may be stand alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 3:
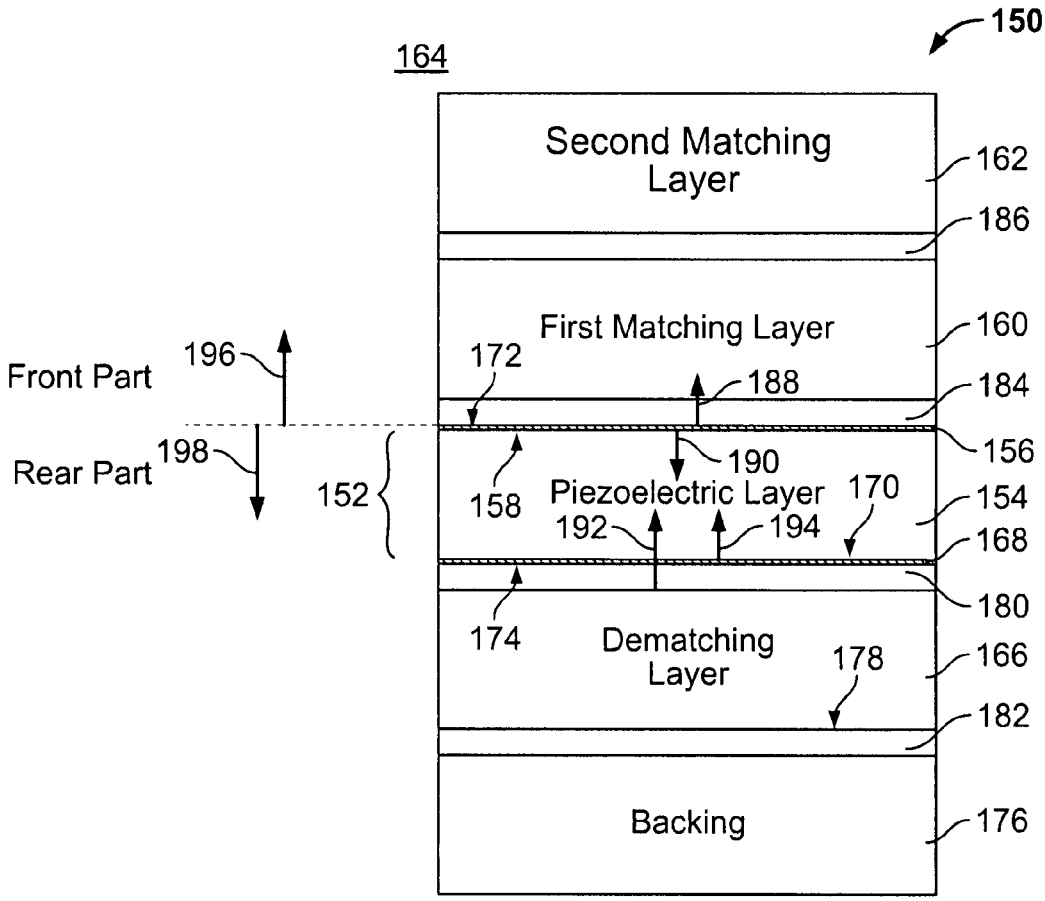
FIG. 3 illustrates an acoustical stack formed in accordance with an embodiment of the present invention that is used within a transducer as shown in FIG. 1.

FIG. 1 illustrates an ultrasound system 100 including a transmitter 102 that drives an array of elements 104 (e.g., piezoelectric elements) within a transducer 106 to emit pulsed ultrasonic signals into a body. Each of the elements 104 corresponds to an acoustical stack (as shown in FIG. 3). The elements 104 may be arranged, for example, in one or two dimensions. A variety of geometries may be used. Each transducer 106 has a defined center operating frequency and bandwidth. The ultrasonic signals are back-scattered from structures in the body, like fatty tissue or muscular tissue, to produce echoes that return to the elements 104. The echoes are received by a receiver 108. The received echoes are passed through a beamformer 110, which performs beamforming and outputs an RF signal. The RF signal then passes through an RF processor 112. Alternatively, the RF processor 112 may include a complex demodulator (not shown) that demodulates the RF signal to form IQ data pairs representative of the echo signals. The RF or IQ signal data may then be routed directly to a memory 114 for storage.

The ultrasound system 100 also includes a processor module 116 to process the acquired ultrasound information (e.g., RF signal data or IQ data pairs) and prepare frames of ultrasound information for display on display 118. The processor module 116 is adapted to perform one or more processing operations according to a plurality of selectable ultrasound modalities on the acquired ultrasound information. Acquired ultrasound information may be processed and displayed in real-time during a scanning session as the echo signals are received. Additionally or alternatively, the ultrasound information may be stored temporarily in memory 114 during a scanning session and then processed and displayed in an off-line operation.

The processor module 116 is connected to a user interface 124 that may control operation of the processor module 116 as explained below in more detail. The display 118 includes one or more monitors that present patient information, including diagnostic ultrasound images to the user for diagnosis and analysis. One or both of memory 114 and memory 122 may store three-dimensional (3D) data sets of the ultrasound data, where such 3D datasets are accessed to present 2D and 3D images. Multiple consecutive 3D datasets may also be acquired and stored over time, such as to provide real-time 3D or 4D display. The images may be modified and the display settings of the display 118 also manually adjusted using the user interface 124.

Figure 2:
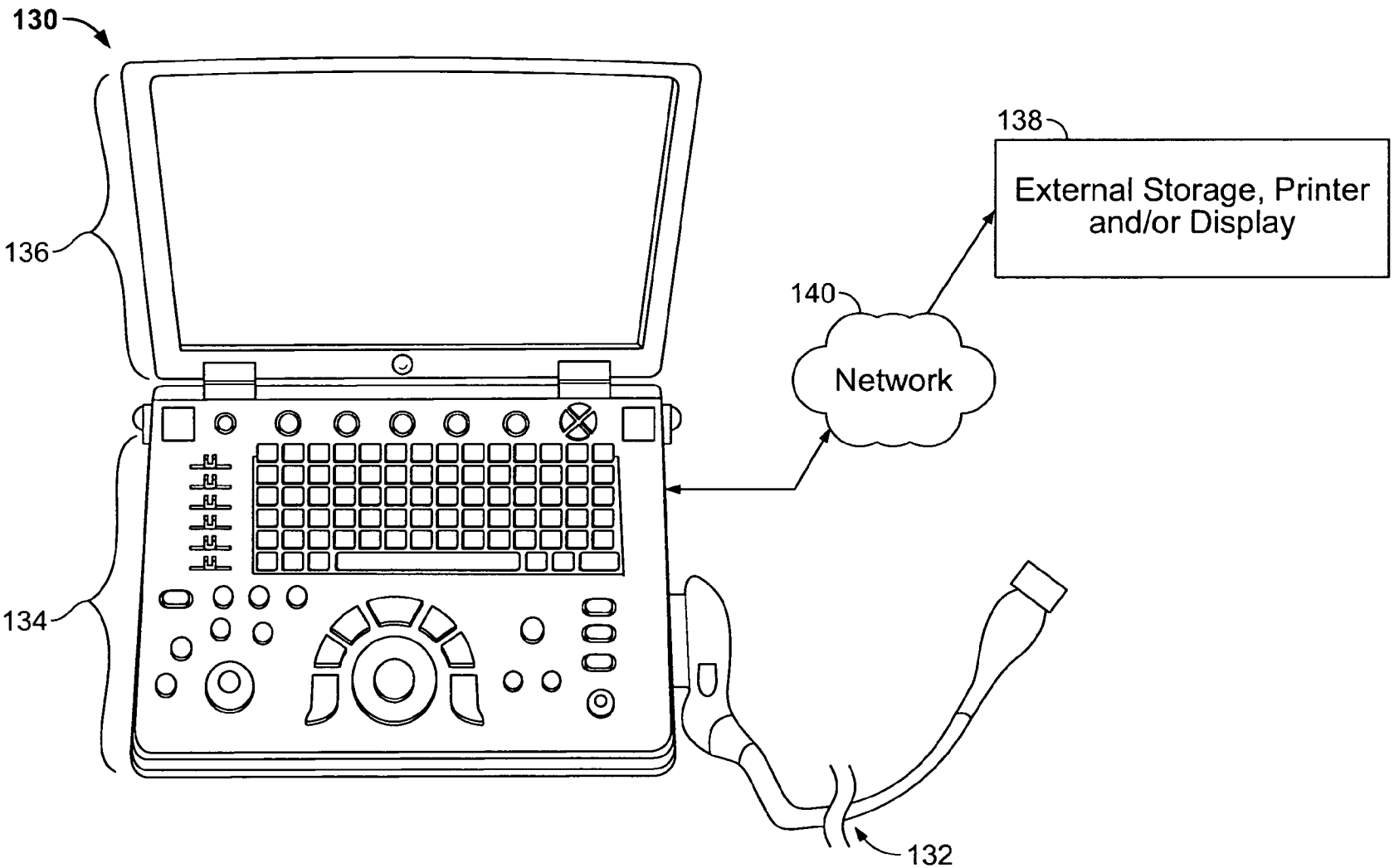
FIG. 2 illustrates a miniaturized ultrasound system having a transducer that may be configured to acquire ultrasonic data in accordance with an embodiment of the present invention.

FIG. 2 illustrates a 3D-capable miniaturized ultrasound system 130 having a transducer 132 that may be configured to acquire 3D ultrasonic data. For example, the transducer 132 may have a 2D array of transducer elements 104 as discussed previously with respect to the transducer 106 of FIG. 1. A user interface 134 (that may also include an integrated display 136) is provided to receive commands from an operator. As used herein, "miniaturized" means that the ultrasound system 130 is a handheld or hand-carried device or is configured to be carried in a person's hand, pocket, briefcase-sized case, or backpack. For example, the ultrasound system 130 may be a hand-carried device having a size of a typical laptop computer, for instance, having dimensions of approximately 2.5 inches in depth, approximately 14 inches in width, and approximately 12 inches in height. The ultrasound system 130 may weigh about ten pounds, and thus is easily portable by the operator. The integrated display 136 (e.g., an internal display) is also provided and is configured to display a medical image.

The ultrasonic data may be sent to an external device 138 via a wired or wireless network 140 (or direct connection, for example, via a serial or parallel cable or USB port). In some embodiments, external device 138 may be a computer or a workstation having a display. Alternatively, external device 138 may be a separate external display or a printer capable of receiving image data from the hand carried ultrasound system 130 and of displaying or printing images that may have greater resolution than the integrated display 136.

As another example, the ultrasound system 130 may be a 3D capable pocket-sized ultrasound system. By way of example, the pocket-sized ultrasound system may be approximately 2 inches wide, approximately 4 inches in length, and approximately 0.5 inches in depth and weigh less than 3 ounces. The pocket-sized ultrasound system may include a display, a user interface (i.e., keyboard) and an input/output (I/O) port for connection to the transducer (all not shown). It should be noted that the various embodiments may be implemented in connection with a miniaturized ultrasound system having different dimensions, weights, and power consumption.

FIG. 3 illustrates an acoustical stack 150 that is used within a transducer 106 as shown in FIG. 1. As discussed previously, each transducer 106 may have many acoustical stacks 150, and each of the elements 104 within the transducer 106 corresponds to an acoustical stack 150.

The acoustical stack 150 has several layers attached together in a stacked configuration. A piezoelectric layer 152 may be formed of a piezoelectric material 154 such as lead zirconate titanate (PZT) piezoelectric ceramic material, but it should be understood that other piezoelectrical material or piezocomposite material (e.g. single crystal, piezoelectric polymer, ceramic composites, single crystal composites, monolithic or multi-layer structure, and the like) may be used. The piezoelectric material may have a thickness of approximately $$1/4 \text{ of Lamba } \left(\frac{\lambda}{4}\right),$$

wherein $\lambda$ is the wavelength of sound in the piezoelectric material 154. A first electrode 156 may be formed with a thin metallic layer and is deposited on front face 158 of the piezoelectric material 154. A second electrode 168 is deposited on rear face 170 of the piezoelectric material 154. In another embodiment, more than one layer of material may be used. A multi-layer piezoelectric stack (not shown) may be formed of two or more of any piezoelectric material or piezocomposite material, and the materials of the different layers may be different with respect to each other. For example, a bi-layer piezoelectric stack may be formed wherein one layer is monolithic piezoelectric material and another layer is piezocomposite material.

A set of matching layers, such as first and second matching layers 160 and 162, are attached to top side 172 of the piezoelectric layer 152 to match the acoustic impedances between the stack 150 and an exterior 164, which may be based on the acoustic impedance of a human or other subject to be scanned. In other embodiments, there may be one matching layer, more than two matching layers, or a graded impedance matching layer. A dematching layer 166 is interconnected at a bottom side 174 of the piezoelectric layer 152, and a backing 176 is attached at a bottom side 178 of the dematching layer 166.

For discussion, the stack 150 may be divided into front and rear parts 196 and 198 with respect to the top side 172 of the piezoelectric layer 152. The layers of the stack 150 are acoustically joined with one or more materials such as glue, adhesive, solder or other assembly layer material. The assembly layer material is shown as assembly layers 180, 182, 184 and 186. In the rear part 198, the assembly layer 180 joins the piezoelectric layer 152 and the dematching layer 166, and the assembly layer 182 joins the dematching layer 166 and the backing 176. In the front part 196, the assembly layer 184 joins the piezoelectric layer 152 and the first matching layer 160, and the assembly layer 186 joins the first and second matching layers 160 and 162.

When the first and second electrodes 156 and 168 are polarized, the piezoelectric material 154 is electrically excited, generating first and second mechanical waves 188 and 190 that start from the top side 172 of the piezoelectric layer 152. The first mechanical wave 188, which may also be called an initial front wave, is directed toward the front part 196 of the stack 150 and the second mechanical wave 190 is directed toward the rear part 198 of the stack 150. When the second mechanical wave 190 reaches the dematching layer 166, the strong mismatch in impedance between the piezoelectric and dematching layers 152 and 166 generates a first reflected wave 192, resulting in only a minor quantity of energy leak inside the backing 176. The thicknesses of the stack layers may be chosen to allow constructive phase matching between the first mechanical wave 188 and the first reflected wave 192. The interface between the piezoelectric layer 152 and the assembly layer 180 also induces a perturbation of the acoustic wave propagation, resulting in second reflected wave 194.

For operation in a wide bandwidth range, the acoustic impedance of the dematching layer 166 needs to be much larger than the acoustic impedance of the piezoelectric layer 152. The choice of material for the piezoelectric and dematching layers 152 and 166 and the material and thickness of the assembly layer 180 is important, especially for a transducer 106 operating at relatively higher frequencies.

As discussed previously, the theoretical prediction of the performance of the piezoelectric and dematching layers 152 and 166 generally assumes that direct contact is achieved across the surfaces of the piezoelectric and dematching layers 152 and 166. However, the surface state conditions of the materials are not perfectly smooth or level. Therefore, the surface state conditions of the materials used to form both the piezoelectric and dematching layers 152 and 166 will be discussed with the purpose of allowing the manufacturing of transducers 106 over a broad range of center operating frequencies.

The following analysis focuses on the piezoelectric and dematching layers 152 and 166 and the assembly layer 180 within the rear part 198 of the stack 150. It is assumed that the average density and acoustic impedance of the backing 176 and the materials used in the assembly layer 182 are sufficiently similar to each other (e.g. both made of organic material) and thus are not considered in the analysis. Also, the first and second electrodes 156 and 168 have only a second or third order of impact on the performance and thus are not considered.

Figure 4:
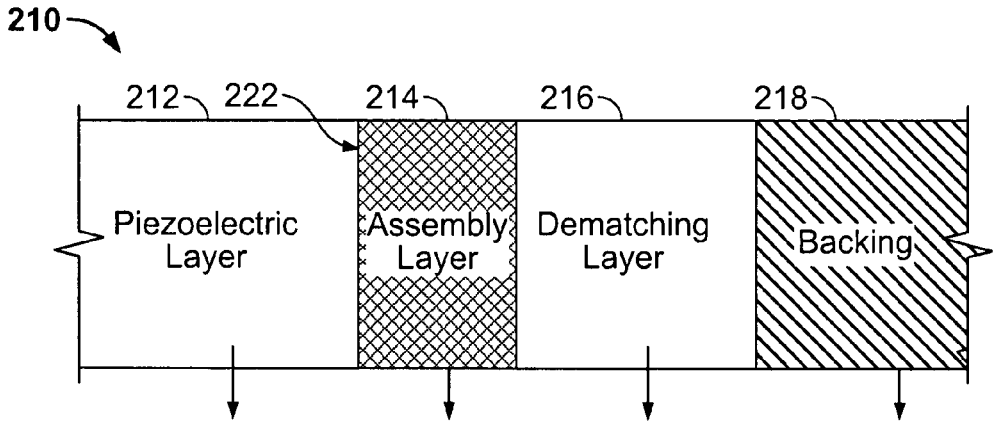
FIG. 4 illustrates a layer arrangement for a rear part of an acoustical stack formed in accordance with an embodiment of the present invention.

Different models of an acoustic transducer 106, such as the MASON model, have been used to develop an analogy between the mechanical and electrical behavior, allowing a simple but efficient simulation of the mechanical transducer 106 by an equivalent electrical circuit. FIG. 4 illustrates a layer arrangement for a rear part 210 of an acoustical stack, such as the rear part 198 of the stack 150 of FIG. 3. In particular, a piezoelectric layer 212, an assembly layer 214, a dematching layer 216, and a backing layer 218 are illustrated. In comparison with FIG. 3, the metallization layers (e.g. first and second electrodes 156 and 168) and the assembly layer between the dematching and backing layers 216 and 218 are not shown. The backing layer 218 and associated assembly material (not shown) are not included in the following analysis.

A transformation matrix may be used to electrically describe each layer of the stack. The electrical response of the acoustically active piezoelectric layer 212, which is more complex, is not taken into account. A layer n may be described in Equation (Eq.) 1 as:

$$\begin{pmatrix} A_n & B_n \\ C_n & D_n \end{pmatrix} = \begin{pmatrix} \cos\gamma_n & jZ_{on}\sin\gamma_n \\ \frac{j\sin\gamma_n}{Z_{on}} & \cos\gamma_n \end{pmatrix} \quad \text{Eq. 1}$$

In Eq. 2, each matrix element relates stress $F_n$ and velocity $v_n$ in layer n with the same parameter in layer n−1:

$$\begin{pmatrix} F_n \\ v_n \end{pmatrix} = \begin{pmatrix} A_n & B_n \\ C_n & D_n \end{pmatrix} \begin{pmatrix} F_{n-1} \\ v_{n-1} \end{pmatrix} \quad \text{Eq. 2}$$

Referring to reference table 220 in FIG. 4, and as with the MASON model, $\rho_n$ indicates the density of material in layer n, $c_n$ is the celebrity of sound in layer n, $l_n$, is the thickness of layer n, and thus $Z_{on}=\rho_n c_n$ indicates the acoustical impedance of layer n. Also, $$\gamma_n = \frac{\pi f}{f_{on}} \text{ where } f_{on} = \frac{c_o}{2l_n}$$

indicates the center frequency at the nominal $\pi/4$ thickness. The transformation (Eq. 2) may be repeated for each layer as required by the acoustical structure.

In the following, "b" indicates a back or rear part 210 of the stack as seen by the piezoelectric layer 212, "assy" indicates the assembly layer 214 and "dml" indicates the dematching layer 216. Eq. 3 is a resulting matrix associated with the rear end of the piezoelectric layer 212 that is the product of matrixes corresponding to the assembly and dematching layers 214 and 216:

$$[M] = \begin{pmatrix} A_b & B_b \\ C_b & D_b \end{pmatrix} = \begin{pmatrix} A_{assy} & B_{assy} \\ C_{assy} & D_{assy} \end{pmatrix} \times \begin{pmatrix} A_{dml} & B_{dml} \\ C_{dml} & D_{dml} \end{pmatrix} \quad \text{Eq. 3}$$

Eq. 4 solves the result of Eq. 3 for the value $Z_b$, which is the impedance of the stack viewed from back surface 222 of the piezoelectric layer 212 and loaded by a backing of impedance ZB (which is an acoustic impedance associated with the backing layer 218):

$$Z_b = \frac{(A_b ZB + B_b)}{(C_b ZB + D_b)} \quad \text{Eq. 4}$$

Through the values of the coefficients $A_b$, $B_b$, $C_b$, $D_b$ of the matrix M, $Z_b$ is a function of the operating frequency f and of the acoustic impedances of the stack materials, specifically the acoustic impedance (ZC) of the piezoelectric layer 212, acoustic impedance (Zdml) of the dematching layer 216, acoustic impedance (Zassy) of the assembly layer 214, and acoustic impedance (ZB) of the backing layer 218. $Z_b$ may therefore be written as a function of frequency in Eq. 5:

$$Z_b(f, ZC, Z_{dml}, Z_{assy}, ZB) \quad \text{Eq. 5}$$

The scale of the problem is based, at least in part, on the center operating frequency $f_0$ of the transducer 106 and it is convenient to replace f by a dimensionless variable f' with $$f' = \frac{f}{f_0}$$

leading to:

$$Z_b(f', ZC, Z_{dml}, Z_{assy}, ZB) \quad \text{Eq. 6}$$

$Z_b$ may now be used in Eq. 7 to define a reflection coefficient R at the back surface 222 of the piezoelectric layer 212:

$$R = \frac{(Z_b - ZC)}{(Z_b + ZC)} \quad \text{Eq. 7}$$

The performance of an acoustic transducer 106 is tied to bandwidth (BW) and insertion loss (IL). BW is strongly connected to IL, as changes in IL across the BW will lead to a changed or perturbed BW (although not always a reduced BW). IL can be estimated from the reflection coefficient R through the expression in Eq. 8:

$$IL(\text{dB}) = 20\log\left(\left|\frac{1+R}{2}\right|\right) \quad \text{Eq. 8}$$

This simple model could be used to predict the behavior of the interface between the piezoelectric and dematching layers 212 and 216. However, it is desirable to select a criterion in order to define the maximum IL allowed at this interface. For example, typical criteria for a transducer 106 may state that for a relative BW of 80 percent, it is desirable that the IL remain above −1 dB of the maximum IL.

Figure 5:
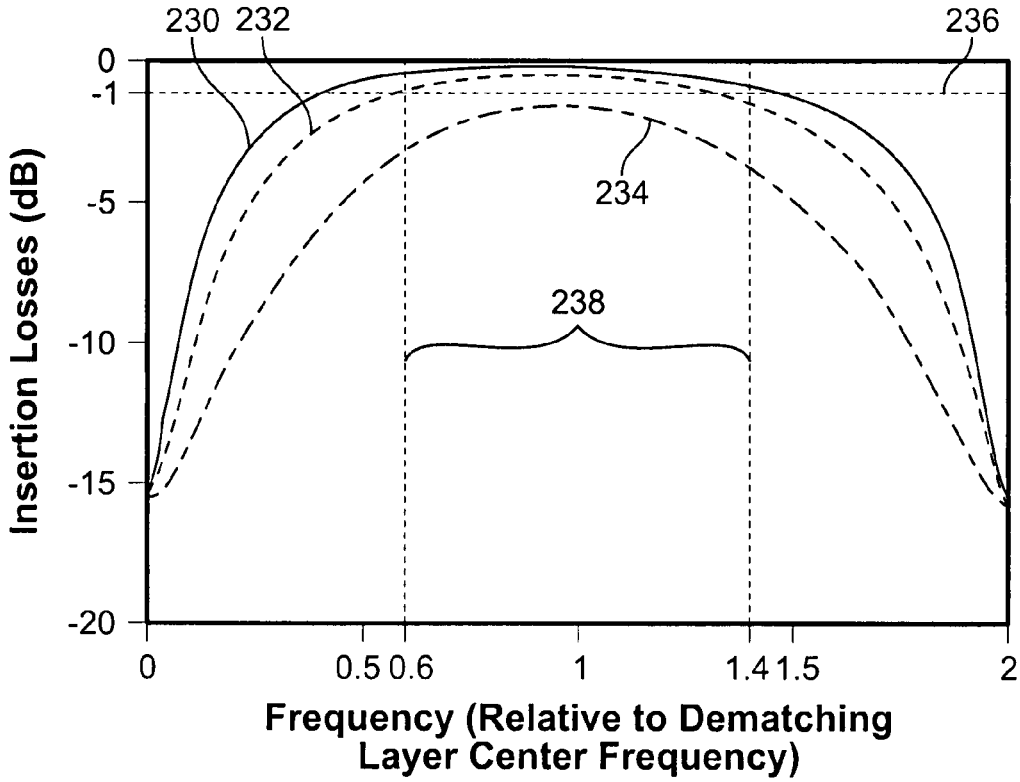
FIG. 5 illustrates insertion loss (IL) for different acoustic impedance ratios between the dematching layer and piezoelectric layer over an 80 percent relative BW excursion of normalized frequency in accordance with an embodiment of the present invention.

The following uses the model to check the influence of the acoustic impedance mismatch between piezoelectric and dematching layer materials forming the piezoelectric and dematching layers 212 and 216, respectively. FIG. 5 illustrates IL for different acoustic impedance ratios between the dematching layer 216 and piezoelectric layer 212 over an 80 percent relative BW 238 excursion of normalized frequency. The horizontal axis illustrates normalized frequency based on a dematching layer wavelength thickness, which is generally close to the transducer center operating frequency. The acoustic impedance ratios n are computed as a relation of the acoustic impedance of the material of the dematching layer 216 divided by the acoustic impedance of the material of the piezoelectric layer 212. Impedance ratio BW curves 230, 232 and 234 correspond to the acoustic impedance ratios equal to 3, 2, and 1, respectively. Line 236 indicates −1 dB of the maximum IL. The impedance ratio BW curves 230, 232 and 234 indicate that an impedance ratio of at least 2 is needed to achieve the expected effect on BW and IL, that is, remain above the line 236 within the 80 percent relative BW 238.

Figure 6:
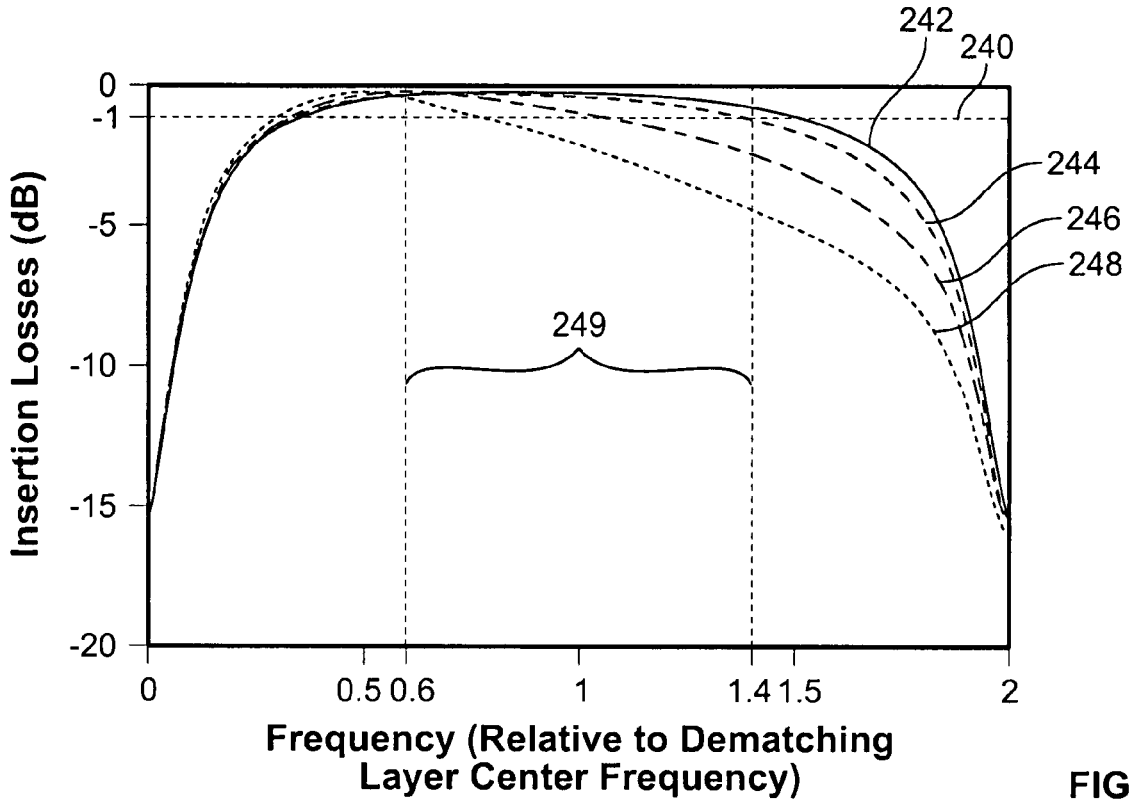
FIG. 6 illustrates IL for different thicknesses of the assembly layer over an 80 percent relative BW excursion of normalized frequency in accordance with an embodiment of the present invention.

The thickness of the assembly layer 214 (of FIG. 4) between the piezoelectric and dematching layers 212 and 216 can also influence the performance of the transducer 106. FIG. 6 illustrates IL for different thicknesses of the assembly layer 214 over an 80 percent relative BW 249 excursion. In this example, the impedance ratio between the materials of the piezoelectric and dematching layers 212 and 216 is held constant and above 2 (as was discussed in FIG. 5). A line 240 indicates −1 dB of the maximum IL. Thickness BW curves 242, 244, 246 and 248 indicate assembly thicknesses $tm_{assy}$ of the assembly layer 214 of 1, 2, 4 and 7 microns (or micrometers), respectively. When the assembly thickness $tm_{assy}$ is greater than 2 microns as shown with the thickness BW curves 246 and 248 that correspond to 4 and 7 microns, respectively, the BW shape is altered and the targeted criteria of less than −1 db insertion loss (as indicated by the line 240) is not achieved. When the assembly thickness $tm_{assy}$ is 1 or 2 microns as shown with the thickness BW curves 242 and 244, respectively, the BW shape indicates performance within the desired criteria of less than −1 dB IL within an 80 percent relative BW 249.

Figure 7:
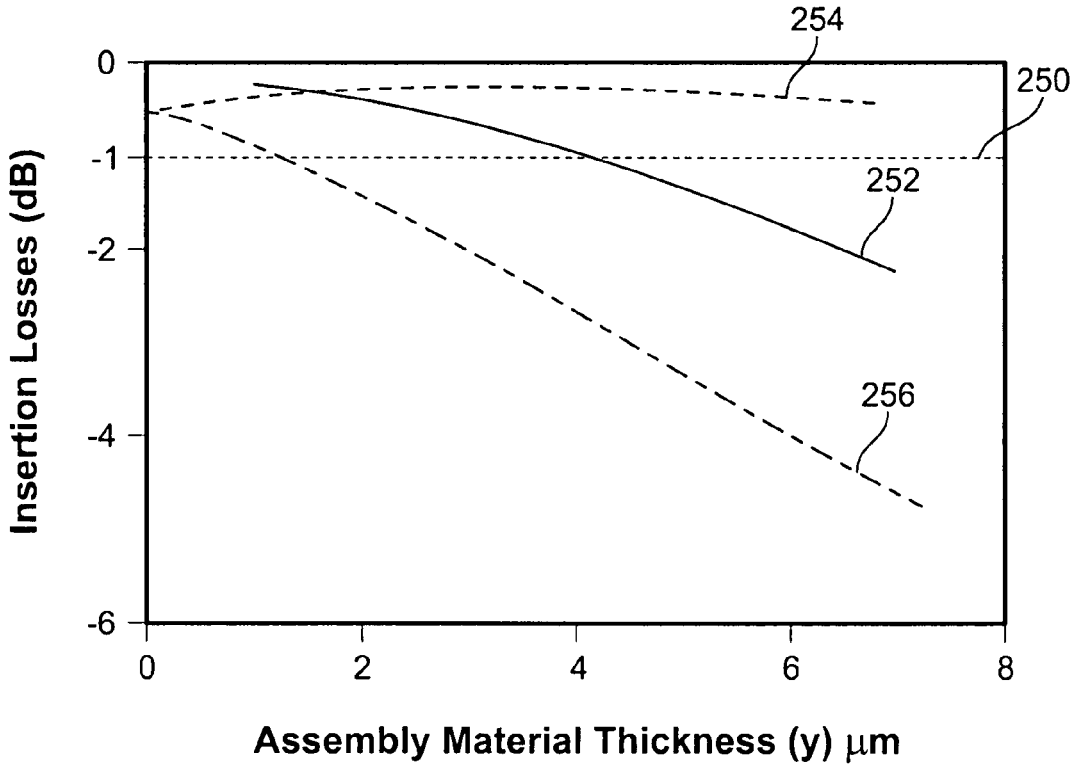
FIG. 7 illustrates IL as a function of the assembly thickness $tm_{assy}$ (y) microns for three relative frequencies (f/fo) over an entire bandwidth allocation of an 8 MHz center frequency transducer in accordance with an embodiment of the present invention.

FIG. 7 illustrates IL as a function of the assembly thickness $tm_{assy}$ (y) microns for three relative frequencies (f/fo) over an entire BW allocation of an 8 MHz center frequency transducer 106. At the center operating frequency (fo), f/fo is equal to 1. In this example, the impedance ratio between the materials of the piezoelectric and dematching layers 212 and 216 is held constant and preferably above 2. A line 250 indicates −1 dB of the maximum IL. Curves 252, 254 and 256 indicate IL values corresponding to relative frequencies (f/fo) equal to 1, 0.6 and 1.4, respectively. As the thickness of the assembly layer 214 increases, performance at higher frequencies decreases to an unacceptable level as indicated by the curves 252 and 256.

Unfortunately, it is difficult or perhaps impossible to realize in practice a perfect surface state as applied in the above simulations, and thus it is desirable to take into account the surface state properties when determining the thickness of the assembly layer 214. The surface state may be described by rugosity and waviness parameters for both of the piezoelectric and dematching material surfaces.

Figure 8:
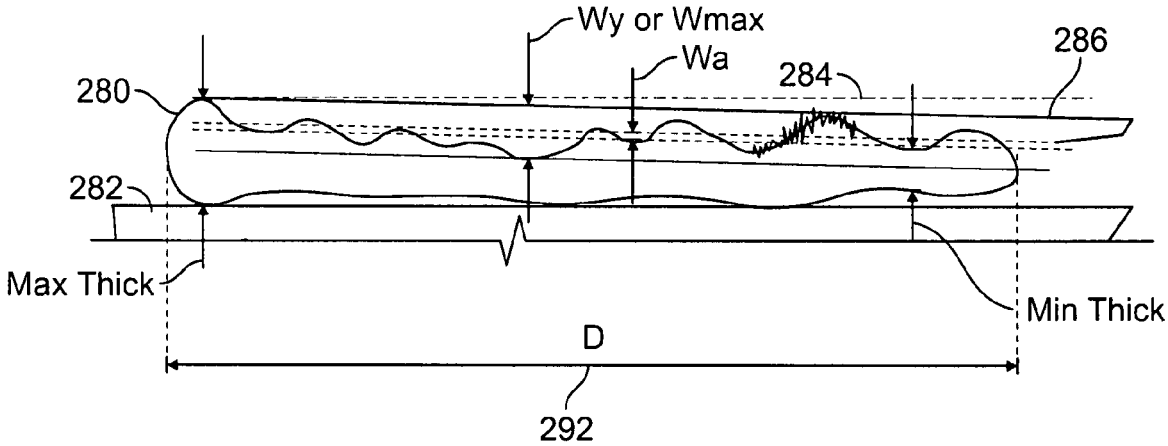
FIG. 8 illustrates a substrate lying on a measurement plane in accordance with an embodiment of the present invention.

One problem with substrate characterization is induced by leveling effects on irregularly shaped substrates. FIG. 8 illustrates a substrate 280 lying on a plane 282. The plane 282 may be a measurement system reference plane and the substrate 280 may be a sheet of material such as the material used to form the piezoelectric or dematching layers 212 and 216. Line 284 is formed parallel to the plane 282 and forms an initial measurement reference. Irregularities of the shape of the substrate 280 may induce an angle, indicated with reference plane 286, which can lead to difficulty in measurement.

Figure 9:
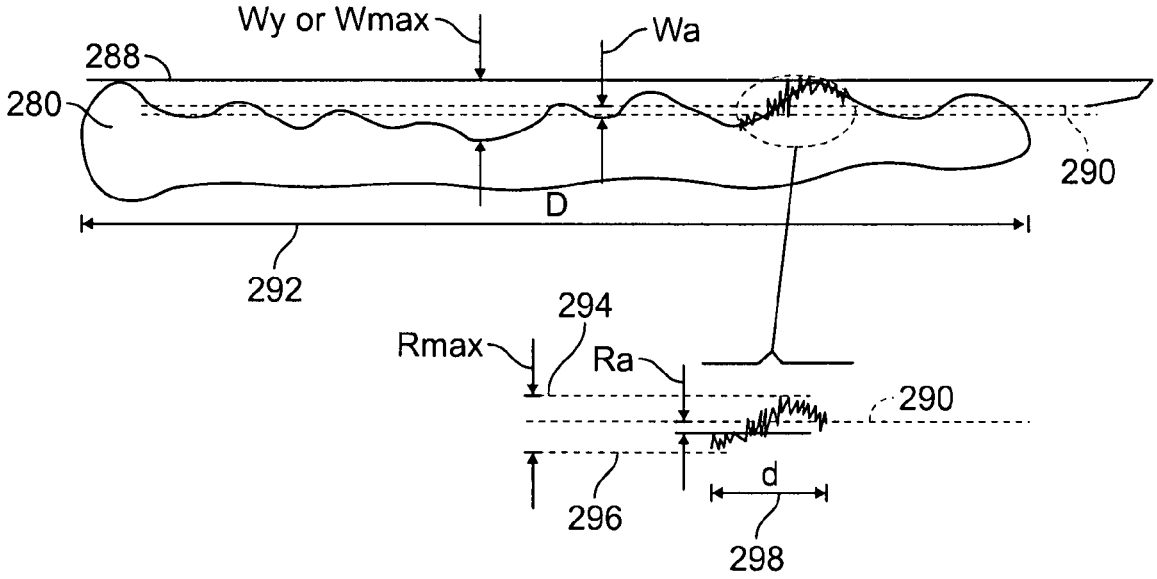
FIG. 9 illustrates a leveling operation that has been performed with respect to the substrate in accordance with an embodiment of the present invention.

FIG. 9 illustrates a leveling operation that has been performed with respect to the substrate 280 before measurement. The reference plane 286 of FIG. 8 is illustrated in FIG. 9 as the leveled measurement reference 288, and will be used for defining the following measurements. All the following calculations will assume a leveled substrate and are made using a one-dimensional measurement line (not shown) across the substrate 280.

A surface waviness (Wa) measurement may be made over the whole distance (D) 292 of the substrate 280 and characterized using a reference mean plane 290 localized at a mean depth value ⟨z'⟩ (e.g. depth of a mean line going through the profile). The depth origin is defined by the measurement of the maximum substrate warp, Wy or W max, which is defined as a variation of thickness below and above the reference mean plane 290 (peak to valley). An average substrate waviness is calculated in Eq. 9 wherein Wa is defined as the averaged arithmetic deviation from the depth of the reference mean plane 290:

$$Wa = \frac{1}{L}\int_0^L |z'(x) - \langle z'\rangle| dx \qquad \text{Eq. 9}$$

In Eq. 9, z'(x) is a deviation at each point along the line from the reference mean plane 290 across the distance D 292.

Surface rugosity (Ra) is similar to waviness, but is concerned with a smaller, more local scale, such as a distance d 298. A peak position and a valley position are determined along the distance d 298, corresponding to the highest and lowest points. First and second lines 294 and 296 are set tangent to the peak and valley positions and are parallel to each other. A value of $R_{max}$ may be determined as the greatest variation of thickness along the local sampling length, distance d 298.

The following Eq. 10 assumes that the mean depth value ⟨z⟩(associated with Ra) corresponds to the reference mean plane 290. The origin of the depth is set at the plane tangent to the peak position (e.g. first line 294). An average substrate rugosity is calculated in Eq. 10 wherein Ra is defined as the averaged arithmetic deviation from the mean plane depth ⟨z⟩, which is a measurement made using the standard DIN 4768 method over a small part, such as over the distance d 298 of the substrate 280.

$$Ra = \frac{1}{l}\int_0^l |z(x) - \langle z\rangle| dx \qquad \text{Eq. 10}$$

In Eq. 10, z(x) is the deviation from the reference mean plane 290 across the distance d 298.

It should be understood that the Wa and Ra parameters may be provided as specifications for the piezoelectric and dematching materials.

According to the thickness of the assembly compound $tm_{assy}$ as discussed previously and shown in FIG. 7, the following relations should be verified in order to achieve the desired performance. In terms of Wa, certain conditions should be met when determining whether the particular sample of surface material is suitable for the desired stack 150 configuration, such as at achieve the desired operating frequency. In one example, a surface state may be determined to be suitable when the mean depth value ⟨z'⟩ measured across the whole measurement line (such as the distance D 292 of FIG. 8) remains below a maximum thickness value $tm_{assy}$ of the assembly material. The relation is shown in Eq. 11:

$$\frac{1}{L}\int_0^L [z'(x) - \langle z'\rangle] dx + \langle z'\rangle \le tm_{assy} \qquad \text{Eq. 11}$$

In another example, in terms of the Wa parameter, if the following relation in Eq. 12 is always true (or assumed to be true):

$$\frac{1}{L}\int_0^L (z'(x) - \langle z'\rangle) dx \le \frac{1}{L}\int_0^L |z'(x) - \langle z'\rangle| dx \qquad \text{Eq. 12}$$

Then the following criteria may be used:

$$Wa + \langle z'\rangle \le tm_{assy} \qquad \text{Eq. 13}$$

In other words, the Wa plus the mean depth value (z') of the piezoelectric or dematching material should remain equal to or below the determined assembly material thickness.

For a very flat or smooth surface, the Ra parameter may be considered without the Wa parameter:

$$\frac{1}{l}\int_0^l [z(x)-\langle z\rangle]dx+\langle z\rangle \le tm_{assy} \quad \text{Eq. 14}$$

When using the Ra parameter, if the following relation is always true (or assumed to be true):

$$\frac{1}{l}\int_0^l (z(x)-\langle z\rangle)dx \le \frac{1}{l}\int_0^l |z(x)-\langle z\rangle|dx \quad \text{Eq. 15}$$

Then the following criteria may be used:

$$Ra+\langle z\rangle \leqq tm_{assy}. \quad \text{Eq. 16}$$

These results or criteria, defined along a single line, may be generalized over the whole substrate area either by continuous integration or by sampling integration, leading to the same controlling parameters Ra or Wa.

For complex surface states, Wa and Ra may be considered altogether as shown in the relation of Eq. 17:

$$Wa+\langle z'\rangle+Ra+\langle z\rangle \leqq tm_{assy} \quad \text{Eq. 17}$$

By way of example only, for surfaces having very high values of Wa and <z'>, Ra and <z> may be disregarded, and the relation may consider only Wa and <z'>. For small values of Wa and <z'>, Wa and <z'> may be disregarded, and the relation may consider only Ra and <z>.

Figure 10:
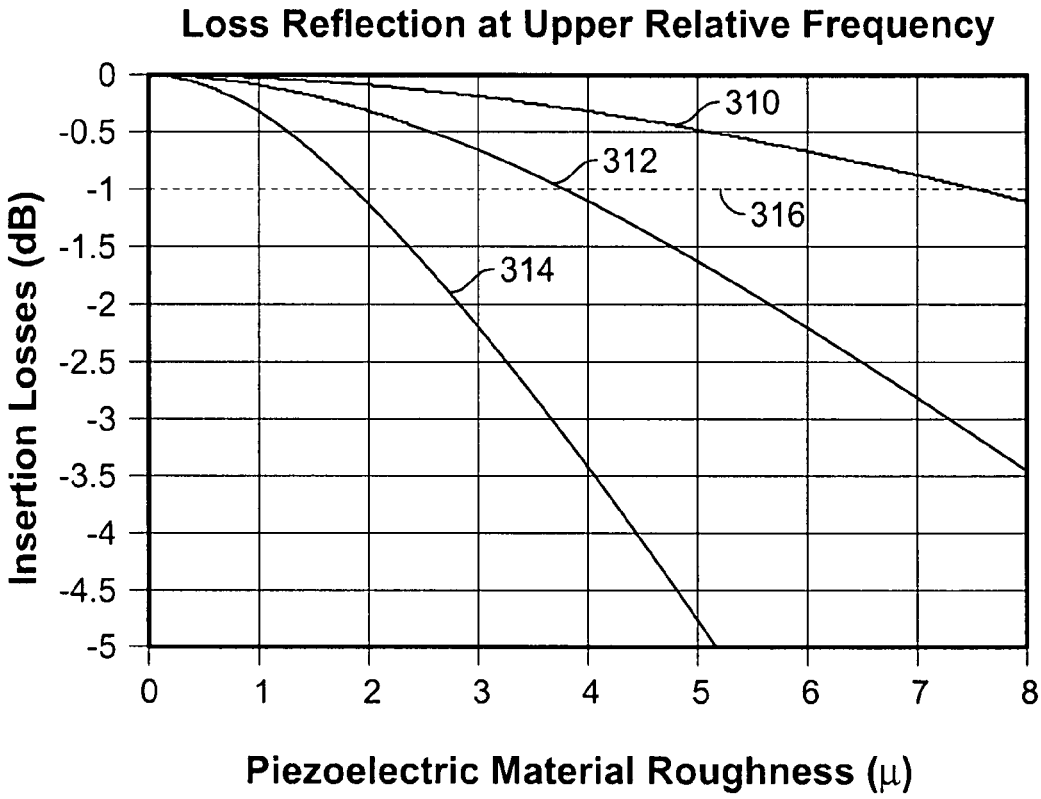
FIG. 10 illustrates a relation of IL and roughness of the piezoelectric material for several different center operating frequencies (fo) in accordance with an embodiment of the present invention.

Based upon the parameters defined here above, three different simulations taking into account the influence of one or both of Ra and Wa are discussed below in FIGS. 10, 11 and 12. FIG. 10 illustrates a relation of IL and roughness of the piezoelectric material for ultrasound transducers 106 at several different center operating frequencies (fo). In this example, the piezoelectric material is PZT and the dematching material is cobalt bonded Tungsten Carbide (WC). The calculation assumes a flat WC surface and a PZT roughness filled by an assembly material that is used for acoustically bonding the piezoelectric and dematching materials. The assembly material in this example may be glue having an acoustical impedance of approximately 4 megaRayls (MR). Line 316 indicates −1 dB of IL. Curves 310, 312 and 314 are estimations of the IL at relative frequencies of 1.4 (f/fo=1.4), which is the upper BW frequency for transducers 106 having center operating frequencies of 2.5 MHz, 5 MHz and 10 MHz, respectively. The performance is greatly decreased at the center operating frequency 10 MHz as shown by the curve 314, as the IL falls below the line 316 before the roughness of 2 microns is reached.

Figure 11:
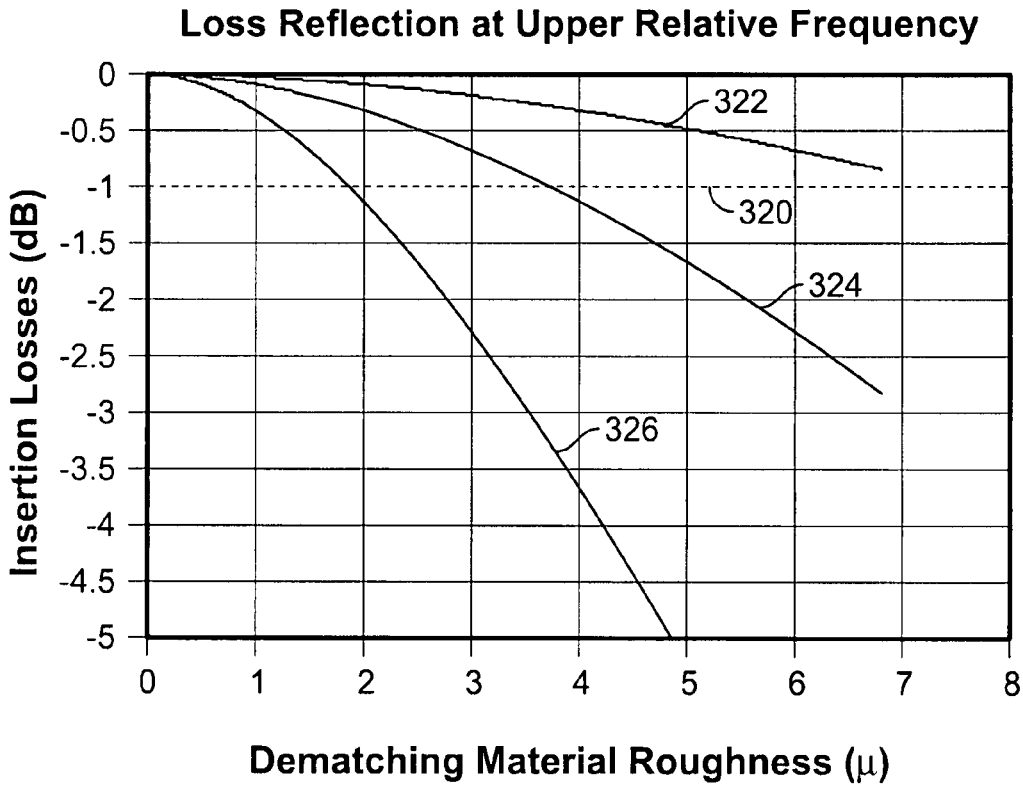
FIG. 11 illustrates a relation of IL and roughness of the dematching material for several different center operating frequencies (fo) in accordance with an embodiment of the present invention.

FIG. 11 illustrates a relation of IL and roughness of the dematching material for several different center operating frequencies (fo). In this example, the dematching material is WC with Cobalt binder, the piezoelectric material is PZT, and the calculation assumes a flat PZT surface and a WC roughness filled by the assembly material, such as a glue having an acoustical impedance of approximately 4 MR. Alternatively, the assembly material may have an acoustical impedance that is less than 4 MR or greater than 4 MR, such as within the range of 4-5 MR. Line 320 indicates −1 dB of IL. Curves 322, 324 and 326 are estimations of the IL at relative frequencies of 1.4 (f/fo=1.4), which is the upper BW frequency for transducers 106 having center operating frequencies of 2.5 MHz, 5 MHz and 10 MHz, respectively. The performance is greatly decreased for the center operating frequency 10 MHz as shown by the curve 326 as the IL falls below the line 320 before the roughness of the dematching material of 2 microns is reached.

Figure 12:
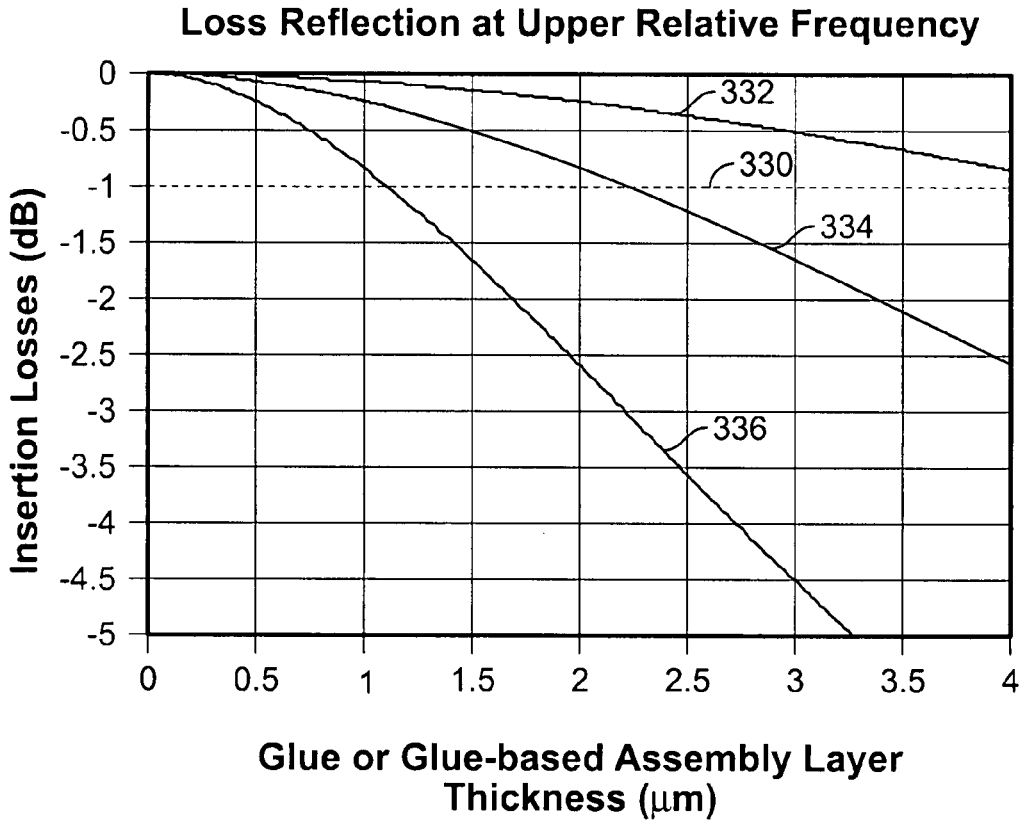
FIG. 12 illustrates a relation of IL to a thickness of the assembly material between the piezoelectric and dematching layers for several different center operating frequencies (fo) in accordance with an embodiment of the present invention.

FIG. 12 illustrates a relation of IL to a thickness of the assembly material between the piezoelectric and dematching layers 212 and 216 for several different center operating frequencies (fo). In this example, the assembly material is an organic epoxy or other glue having an acoustical impedance of approximately 4 MR, and the piezoelectric material (PZT) and dematching material (WC) are assumed to be perfectly flat. Line 330 indicates −1 db of IL. Curves 332, 334 and 336 are estimations of the IL at 1.4 (f/fo=1.4) which is the upper BW frequency for transducers 106 having center operating frequencies of 2.5 MHz, 5 MHz and 10 MHz, respectively. The performance is greatly decreased as shown by both of the curves 334 and 336 as the thickness of the assembly material increases. Therefore, it is desirable to specify and control the thickness of the assembly layer 214 as a function of frequency. By way of example only, for transducers 106 having center operating frequencies below 8 MHz and above about 2.9 MHz, an organic material with acoustical impedance below 4 MR may be used for the assembly material to join the piezoelectric and dematching layers 212 and 216 and form an acoustical connection there-between, and the assembly layer thickness, $tm_{assy}$, should remain below 2.5 microns.

Referring to the simulations illustrated in FIGS. 10 and 11, for a 5 MHz center frequency transducer, the sum of the Ra and/or Wa of both of the piezoelectric and dematching materials should remain equal to or below 4 microns ($tm_{assy} \leqq 4$ μm), as indicated by the curves 312 and 324. As illustrated in FIG. 12, the maximum thickness of the assembly layer 214 should be approximately 2 microns. A maximum thickness of the assembly layer 214 for a transducer 106 having a center operating frequency of 5 MHz may be determined based on an operating frequency (f) as:

$$tm_{assy}(f) = tm_{assy}(2\text{ MHz}) \times \frac{5\text{ MHz}}{f\text{MHz}} \quad \text{Eq. 18}$$

Therefore, thickness of the assembly layer is based on the operating frequency and the center operating frequency of the transducer 106, and it is desirable that the thickness of the assembly layer remain below the maximum thickness based on the highest expected operating frequency (f). Also, as the center operating frequency rises, the maximum thickness of the assembly layer 214 decreases.

By way of example only, for perfectly flat piezoelectric and dematching material surfaces, the thickness of glue forming the assembly layer 214 $tm_{glue}$(fMHz) is $$\text{below } 2.5\ \mu\text{m} \times \frac{8\text{ MHz}}{f(\text{MHz})}, \text{ or } \left(tm_{glue}(f\text{MHz})(2.5\ \mu\text{m} \times \frac{8\text{ MHz}}{f(\text{MHz})}\right).$$

For ultrasound transducers 106 having relatively low center operating frequencies, a standard assembly process using glue or glue-based assembly material may be used. The above calculations may be used to define specifications for the material surfaces as well as glue thickness. However, for ultrasound transducers 106 having relatively high center operating frequencies, the desired performance may not be achieved by assembling the piezoelectric and dematching layers 212 and 216 using the standard glue (e.g. by using organic compound) and thus some form of soldering or other high acoustic impedance material may be introduced. The assembly using solder or other metallic material may be accomplished in a standard fashion using a solder paste, by using a cold welding operation, or other joining operation. When using solder or other metallic materials, sensitivity to thickness of the assembly layer 214 is less critical as the acoustic impedance of the assembly material is much higher than typical impedance values for glue.

Figure 13:
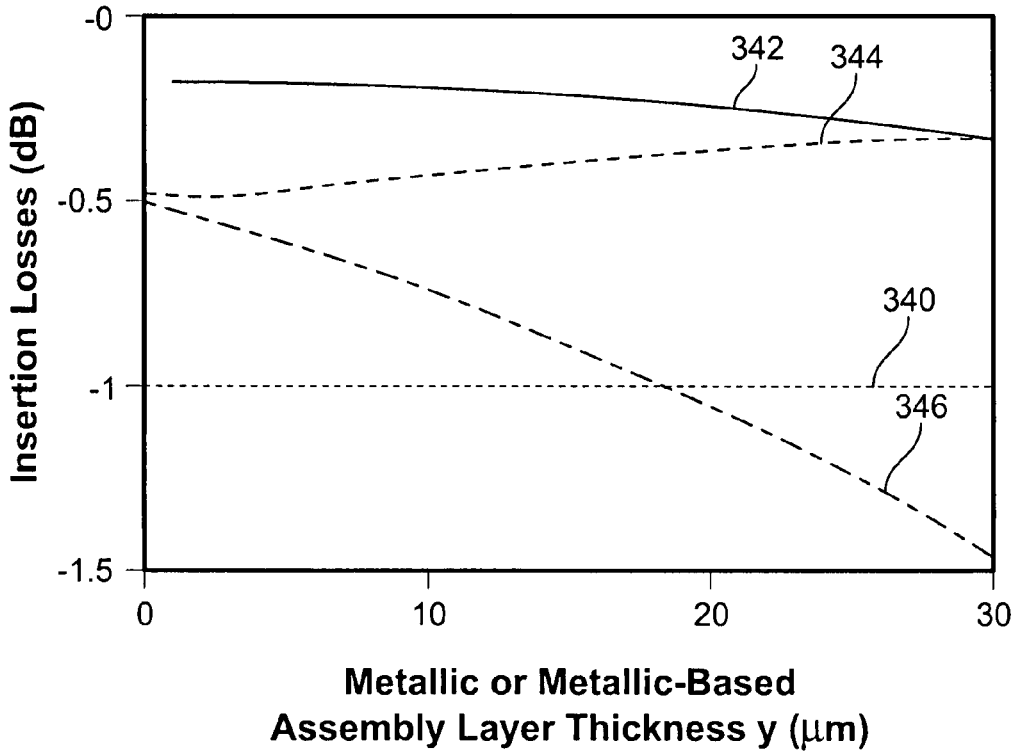
FIG. 13 illustrates a relation of IL to an assembly layer thickness of a metallic assembly material between the piezoelectric and dematching layers at several different relative frequencies (f/fo) in accordance with an embodiment of the present invention.

FIG. 13 illustrates a relation of IL to an assembly layer thickness of a metallic or metallic based assembly material between the piezoelectric and dematching layers 212 and 216 for an ultrasound transducer 106 having an 8 MHz center operating frequency (fo=8 MHz) at several different relative frequencies (f/fo). Line 340 indicates −1 db of IL. In this example, the simple Mason model has been used to estimate the influence of a non-organic assembly material that has an acoustic impedance much higher than the organic assembly material that is typically used, such as the organic material of FIG. 12. The non-organic material has a high density and may be a metallic, metallic-based and/or compound having at least one metallic element within the assembly material. It should be understood that the assembly material may be composed of other substances that also have high acoustic impedance and/or high density with respect to the organic glue-based assembly material. Curves 342, 344 and 346 indicate IL for three different values of relative frequencies (f/fo) of 1, 0.6 and 1.4, respectively, as a function of the thickness y (μm) of the assembly material. In this example, the acoustic impedance ratio between the piezoelectric and dematching layer materials is kept constant and above 2. In contrast with FIG. 7, the assembly layer thickness may rise to nearly 20 micron without distortion of the IL over the full 80 percent BW. Therefore, the metallic or metallic-based material may be used over a much larger range of thickness values than the standard glued assembly.

Regardless of the assembly material used, rugosity and waviness criteria remain important as large Ra or Wa values for the piezoelectric or dematching layer materials may lead to voids in the assembly, which, if not filled by the assembly material may lead to an unsuitable impedance mismatch. This may cause greatly diminished performance and/or rejection of the stacked materials, leading to poor yields.

Figure 14:
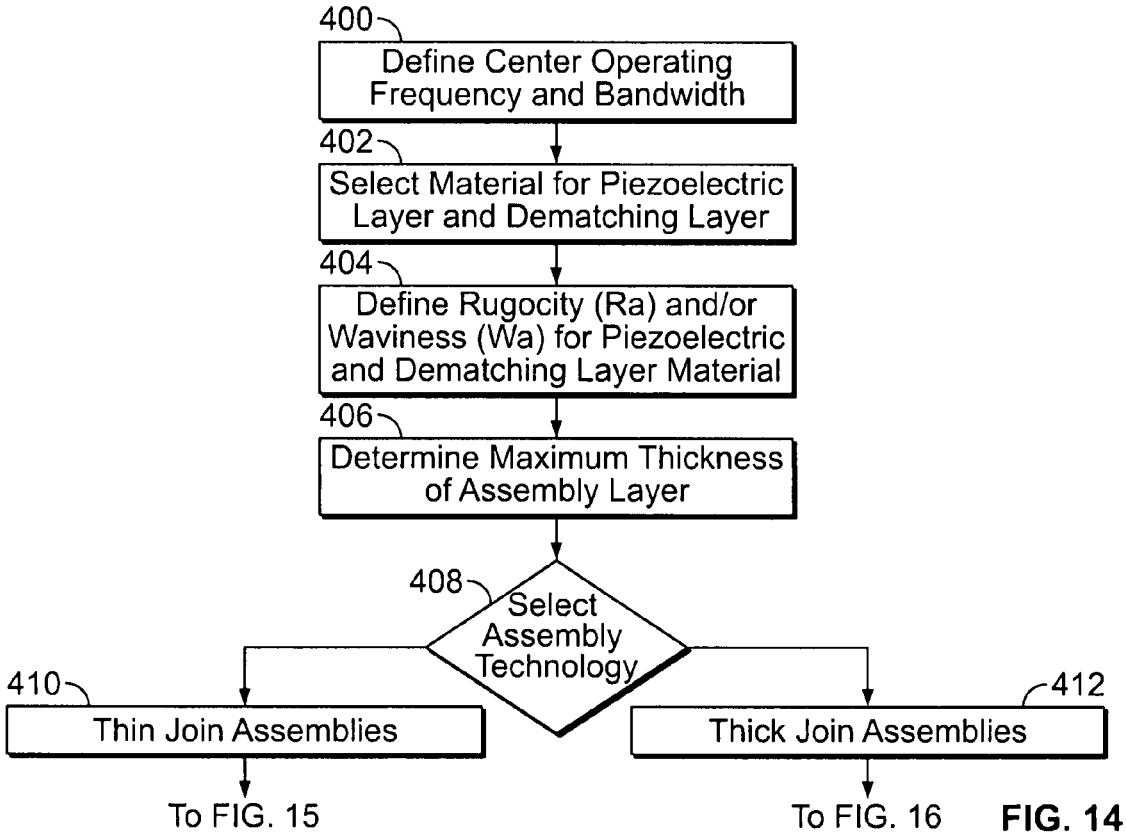
FIG. 14 illustrates a selection of a join method that may be used to join piezoelectric and dematching layers used in the manufacture of an ultrasound transducer in accordance with an embodiment of the present invention.

FIG. 14 illustrates a selection of a join method that may be used to join piezoelectric and dematching layers 212 and 216 used in the manufacture of an ultrasound transducer 106, forming an acoustical connection between the piezoelectric and dematching layers 212 and 216. At 400 a desired center operating frequency (fo) and BW are defined. In one embodiment, the transducer 106 is desired to have defined insertion losses, such as below −1 dB within a relative BW of at least 80 percent.

At 402, a piezoelectric material and dematching material are selected. The piezoelectric material and dematching material may be selected based at least on the impedance ratio between the materials as discussed previously in FIG. 5. In one embodiment, a PZT ceramic is selected as the piezoelectric layer 212. The dematching layer material may be selected to achieve an acoustic impedance ratio that is equal to or greater than 2 between the piezoelectric and dematching layer materials. The dematching layer 216 may be formed of a high impedance material. In one embodiment, the high impedance material may be high impedance metals such as, but not limited to, Tungsten and Tantalum. By way of example, the high impedance material may be based on WC-based alloys. In another embodiment, the high impedance material may be WC and include Cobalt as a binder, wherein the percentage of Cobalt may be in the 6 percent to 25 percent range with respect to the entire content of the material, or, to allow easier manufacturing, the percentage of Cobalt may be in the 1 percent to 25 percent range. In another embodiment, the high impedance material may be WC and include a mixture of Cobalt and Tantalum Carbide as a binder, wherein the percentage of Cobalt is in the 7 percent to 25 percent range and the percentage of Tantalum Carbide is in the 2 to 14 percent range. In yet another embodiment, the high impedance material may be WC and include Nickel and Carbide-Molybdenum oxide ($Mo_2C$) as a binder, and wherein the percentage of Nickel may be in the 6 percent to 12 percent range and the percentage of $Mo_2C$ may be at least 1.5 percent of $Mo_2C$. In another embodiment, the high impedance material may be WC including a mixture of Nickel, Cobalt and Chromium Carbide ($Cr_3C2$) as a binder, and wherein a percentage of Nickel may be in the 10 percent to 20 percent range, a percent of Cobalt may be in the 2 percent to 5 percent range, and a percent of Chromium Carbide ($Cr_3C2$) may be in the 2 percent to 2.5 percent range. It should be understood that other materials and combinations of materials may be used.

At 404, Ra and Wa may be defined for each of the piezoelectric and dematching materials, such as was discussed in FIGS. 10 and 11. Other considerations may be made when selecting the materials and determining the Ra and Wa parameters, such as the ability to achieve the desired Ra and Wa parameters. For example, it may not be practical, possible, and/or affordable to achieve a particular parameter, such as a Wa parameter of less than one micron on a particular surface. In other embodiments, the criteria may allow more variability, such as Ra of 4 microns on each surface, or a total of 4 microns between both of the surfaces.

At 406, the maximum thickness $tm_{assy}$ of the assembly layer 214 may be determined. It is desirable for the thickness $t_{assy}$ of the assembly material to be less than or equal to the maximum thickness $tm_{assy}$. According to the surface state, the maximum thickness may be controlled by the Ra and/or Wa of one or both of the piezoelectric material and the dematching layer material. In one embodiment, the sum of the rugosity Ra or the waviness Wa and of the mean depth ⟨z'⟩or ⟨z⟩ of the piezoelectric material needs to remain below $tm_{assy}$. In another embodiment, the sum of the rugosity Ra or the waviness Wa and the mean depth ⟨z'⟩ or ⟨z⟩ of the dematching layer material needs to remain below $tm_{assy}$. In yet another embodiment, any suitable combination of Ra and/or Wa of the piezoelectric and dematching layer materials needs to remain below $tm_{assy}$. If the desired parameters cannot be achieved as defined, the Ra and/or Wa of the piezoelectric and/or dematching layer material may be redefined at 404.

At 408, an assembly technology is selected. The assembly technologies are divided for purpose of discussion into thin join assemblies 410 and thick join assemblies 412. The thin join assemblies 410 and thick join assemblies 412 are further discussed in FIGS. 15 and 16, respectively. The selection of assembly technology may be made based on one or a combination of factors such as available technology and available materials. In other words, if a particular assembly technology is not available, an iterative process may result in choosing different piezoelectric and/or dematching materials, or by defining different Ra and/or Wa parameters. The center operating frequency (fo) of the transducer 106 may also be a factor to consider, as well as the maximum thickness $tm_{assy}$ determined in 406. By way of example only, typical glue based assembly layers may be approximately 2 microns, but as illustrated in FIG. 12, a glue-based assembly layer thickness of up to approximately 4 microns may be used for some center operating frequencies. Therefore, in one embodiment it may be desirable to select the thin join assembly 410 when the maximum thickness $tm_{assy}$ is less than 2 microns and optionally less than 4 microns, or within a 2-4 micron range.

In one embodiment, the desired performance for a 10 MHz transducer 106 may be achieved using the metallic-based material for the assembly layer 214 as shown by curve 346 of FIG. 13, while the glue-based assembly material does not achieve the desired performance as shown by curve 336 of FIG. 12. In another embodiment, the desired performance for a 5 MHz transducer 106 may be achieved using either the metallic-based material (possibly in either thin join assembly 410 or thick join assembly 412) as shown by the curve 344 of FIG. 13, or the glue-based material as shown by the curve 334 of FIG. 12. In one embodiment, a transducer 106 having a center operating frequency of at least about 2.9 MHz may be assembled using the thick join assemblies 412, while a transducer 106 having a center operating frequency below 8 MHz and at least about 2.9 MHz may be assembled using the thin join assemblies 410.

Figure 15:
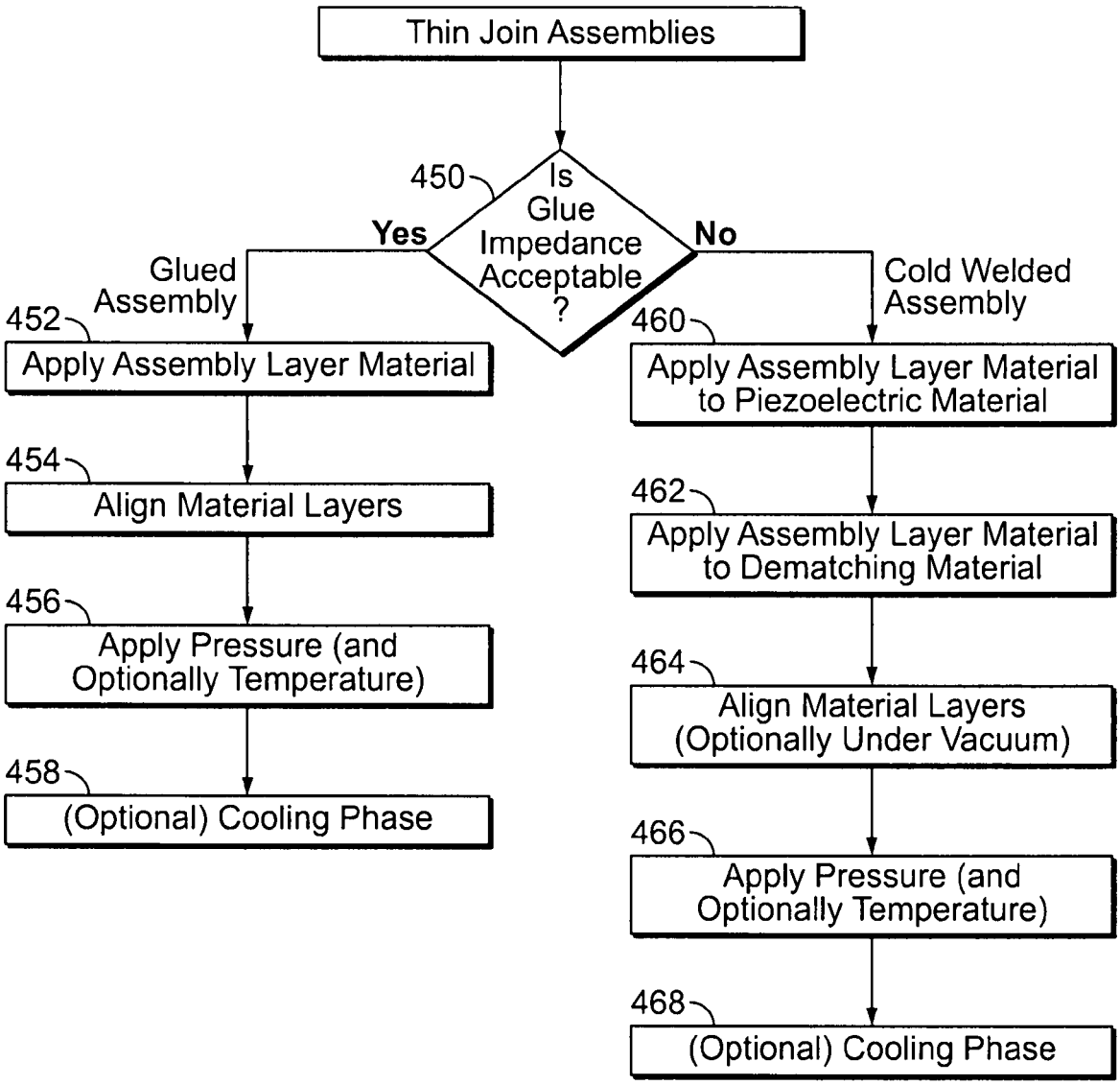
FIG. 15 illustrates exemplary methods used to join the piezoelectric and dematching materials using thin join assemblies in accordance with an embodiment of the present invention.

FIG. 15 illustrates exemplary methods used to realize an acoustically low perturbative assembly structure by joining the piezoelectric and dematching materials using thin join assemblies. In some embodiments, it may be desirable to use the epoxy glue to form the assembly layer 214. It should be understood the term glue is used to refer to organic materials as discussed previously and is not limited to only epoxy glue. Thin join assemblies may also be assembled using a metallic or metallic-based material to form the assembly layer 214.

At 450, it may be determined whether an acoustic impedance of the glue is acceptable. By way of example, an epoxy glue may have an acoustic impedance of approximately 4 MR. In another embodiment, a glue having an acoustic impedance of less than 10 MR may be selected. If a higher impedance is desired, a metallic material may be used. If the use of glue as the assembly layer is acceptable, the method passes to 452 where assembly layer material is applied to one or both of the piezoelectric and dematching layer materials. The thickness of the assembly layer is based on the maximum thickness $tm_{assy}$ as previously determined. At 454, the piezoelectric and dematching layer materials are aligned together manually or by using an alignment tool. The alignment tool or other tool may be configured to apply sufficient pressure at 456 to achieve local contact between the piezoelectric and dematching layer materials through ohmic contact between surface asperities. The determination of the applied pressure value may be defined according to assembly material characteristics. Also at 456, heat may optionally be applied, based on the curing requirements of the material characteristics of the assembly. At 458, if heat was applied, a cooling phase may be used.

Returning to 450, a cold welded process may be selected, which may be a low or ambient temperature mechanical bonding or soldering operation. At 460, an assembly layer material is applied to the piezoelectric material, and at 462 an assembly layer material is applied to the dematching material. The same or different metallic or metallic-based materials may be used as the assembly layer materials at 460 and 462. For a low or ambient temperature mechanical bonding, the assembly layer 214 may be formed of a material characterized by a low chemical reactivity. The total thickness of the assembly layer material that is applied is based at least on the maximum thickness $tm_{assy}$ as previously determined. At 464, the piezoelectric and dematching layer materials are aligned together, such as manually or by using an alignment tool, and optionally under vacuum. The alignment tool or other tool may be configured to apply sufficient pressure at 466. The determination of the applied pressure value may be defined according to material characteristics of the assembly. Optionally, at 466 heat may be applied. At 468, if heat was applied, a cooling phase may be used.

Figure 16:
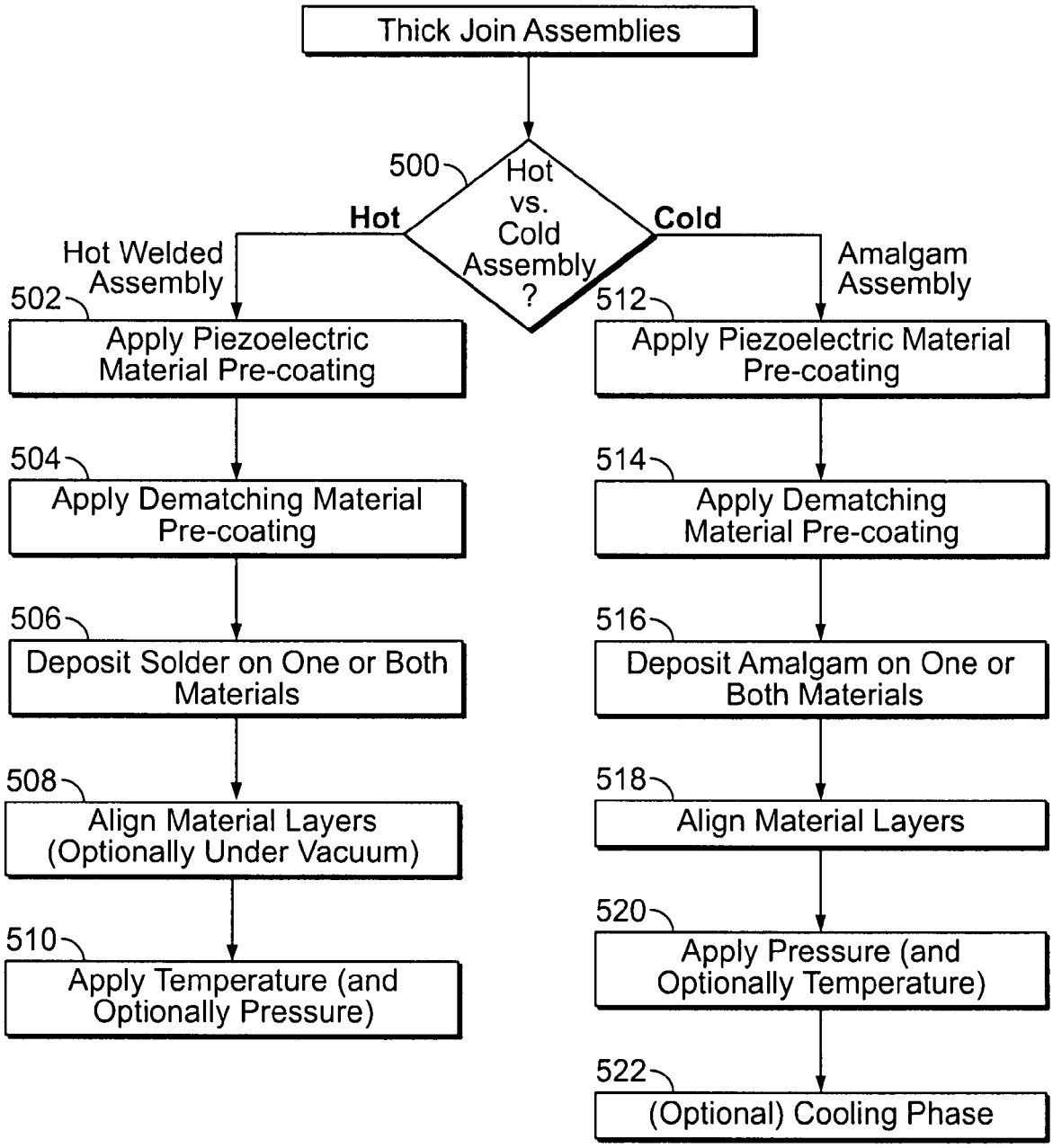
FIG. 16 illustrates exemplary methods used to join the piezoelectric and dematching materials using thick join assemblies in accordance with an embodiment of the present invention.

FIG. 16 illustrates exemplary methods used to join the piezoelectric and dematching materials using thick join assemblies. At 500, a decision may be made whether to use hot assembly method, such as hot, eutectic based welding, or cold assembly method, such as amalgam assembly. Hot welding may be accomplished using a soldering or soldering-like process, while amalgam assembly may refer to a reactive bonding process. For example, each piezoelectric and dematching material has properties that control aspects such as expansion, reaction to heat, reaction to change in temperature either hot or cold, and the like. Therefore, certain materials may be better suited to one method, such as cold welding (FIG. 15), as opposed to hot welding, or may be better suited to the amalgam process.

The hot welding assembly method will be described first. At 502, a pre-coating is applied to the piezoelectric material and at 504 a pre-coating is applied to the dematching material. For example, an adhesion layer, such as a Nickel layer, may be applied. At 506, solder is deposited on one or both of the piezoelectric and dematching materials. The deposited solder will have an initial thickness that will give, after processing, a final thickness $tm_{assy}$ as previously determined. The solder may be a metallic material or compound having at least one metallic material that may be characterized by an acoustical impedance above 30 MR. Also, the metallic joining material or the combination of material may have an eutectic temperature in the 75 to 300° C. range.

The application or deposition of the metallic joining material may be accomplished by using a coating method that allows an isotropic deposition rate allowing the coverage of all the asperities. For example, deposition of the solder coating could be made using vacuum sputtering or another common deposition process to coat one or both surfaces. In another embodiment, a thin sheet of solder may be positioned between the two surfaces, rather than coating one or both of the surfaces.

At 508, the piezoelectric and dematching layer material, with the assembly layer material applied thereon, are aligned, such as by using an alignment fixture, optionally under vacuum. At 510, the piezoelectric and dematching layer materials may be heated to a temperature above the liquidus temperature of the applied solder (the metallic joining material) to reflow the solder into a continuous film. After heat is applied, the layers are held together until the temperature is decreased to the point where the solder has again become solid. Optionally, the alignment fixture or other fixture may be configured to apply pressure to insure contact between the layers of material. In one embodiment, an application of pressure with or without accompanying vibration may be used.

Returning to 500, the piezoelectric and dematching layer materials may also be joined using an amalgam assembly process that may be a reactive bonding process in which a metal, typically an alloy comprised of silver or copper, reacts with mercury to form a solid intermetallic compound with high compression strength. At 512 and 514, one or both of the piezoelectric and dematching materials are pre-coated with a pre-coating material. The pre-coating may be a metallic assembly material that may be an alloy containing silver, tin, and copper, such that the pre-coating material partially reacts with mercury (applied in a subsequent layer) to become part of the reactive bonding process. The metal layer or layers may be applied using a vacuum deposition process. In an alternative embodiment, the pre-coating material is deposited on one of the piezoelectric and dematching layer materials. In this example, an additional second metal containing silver and/or silver alloy may be applied over the first metal. Alternatively, the pre-coating material may be a different metal selected to provide improved adhesion to the surface of either the piezoelectric or dematching layer material.

At 516, a deposition of particles or nanoparticles of an amalgam is applied to at least one of the piezoelectric and dematching layer surfaces that were coated with the pre-coating material. For example, the particles or nanoparticles may be formed of a mixture of silver, tin and mercury (Hg), or a mixture of silver, tin, copper and Hg. In one embodiment, the initial size of the particles may be lower than the total thickness allowed for the assembly layer 214 as determined in 406. At 518, the piezoelectric and dematching layer materials are aligned, such as with an alignment fixture. At 520 the alignment fixture or other fixture may apply pressure to form a continuous assembly layer 214 to acoustically join the piezoelectric and dematching layer materials. In this example, the mercury reacts with the silver alloy and the silver on the piezoelectric and dematching layer materials to form a new solid intermetallic compound $Ag_2Hg_3$ that joins the piezoelectric and dematching layer materials together. Optionally, heat may be applied as was used with the other methods. Optionally, at 522 a cooling phase may be used if heat was applied at 520.

Once the piezoelectric and dematching materials are acoustically joined together, dicing may be accomplished. It should be understood that the other layers as shown in FIG. 3 may be joined before, after or at the same time as the piezoelectric and dematching materials are joined to form the stack 150. Each individual stack 150 may then be used to form individual elements 104 of the transducer 106.

A technical effect of at least one embodiment is using rugosity Ra and waviness Wa parameters to determine a thickness of an assembly layer used to acoustically join piezoelectric and dematching layers when forming an acoustical stack. The thickness of the assembly layer may also be determined based on the center operating frequency of the transducer, as well as the relative operating frequency of the transducer. The assembly material used to form the assembly layer may be an organic material or compound such as a glue or epoxy glue, or may be a metallic or metallic-based compound. The use of the metallic based assembly layer may enable the construction of transducers that operate within desired insertion loss parameters at relatively high frequencies.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

What is claimed is:

1. A method for manufacturing an acoustical stack for use within an ultrasound transducer, comprising:

using a user defined center operating frequency of the ultrasound transducer, the center operating frequency being at least about 2.9 MHz; and joining a piezoelectric material and a dematching material with an assembly material to form an acoustical connection there-between, the piezoelectric material having a first acoustical impedance and at least one of an associated piezoelectric rugosity (Ra) and piezoelectric waviness (Wa), the dematching material having a second acoustical impedance that is different than the first acoustical impedance and at least one of an associated dematching Ra and dematching Wa, the piezoelectric and dematching materials having an impedance ratio of at least 2, the assembly material having a thickness that is based on the center operating frequency and at least one of the piezoelectric Ra, piezoelectric Wa, dematching Ra and dematching Wa.

2. The method of claim 1, wherein the assembly material is an organic material having a third acoustical impedance that is about 4 megaRayls (MR).

3. The method of claim 1, further comprising determining the thickness of the assembly material based on a sum of a mean depth value associated with the piezoelectric material and one of the piezoelectric Ra and Wa.

4. The method of claim 1, further comprising determining the thickness of the assembly material based on a sum of a mean depth value associated with the dematching material and one of the dematching Ra and Wa.

5. The method of claim 1, wherein the thickness of the assembly material is further based on an operating frequency, the operating frequency being associated with the center operating frequency of the transducer.

6. The method of claim 1, wherein the assembly material comprises at least one of a glue, an epoxy glue, a metallic material, a metallic-based material, and a compound having at least one metallic material.

7. The method of claim 1, wherein a sum of rugosity and waviness associated with the piezoelectric and dematching materials should remain equal to and less than 4 microns multiplied times 5 MHz and divided by an operating frequency expressed in MHz, the operating frequency being associated with the center operating frequency of the transducer.

8. The method of claim 1, wherein the assembly material comprises at least one of an organic material and an organic compound, and wherein a maximum thickness of the assembly material is approximately two microns.

9. The method of claim 1, wherein the assembly material comprises at least one of an organic material and an organic compound, and wherein a maximum thickness of the assembly material is less than four microns.

10. The method of claim 1, wherein the assembly material comprises at least one of a metallic material, a metallic-based material, and a compound having at least one metallic material, and wherein a maximum thickness of the assembly material is less than twenty microns.

11. The method of claim 1, wherein the piezoelectric and dematching materials are joined with the assembly material using one of a glued process, cold welding process, hot welding process and an amalgam process.

12. A method for manufacturing an acoustical stack for use within an ultrasound transducer, comprising:

using a user defined center operating frequency of the ultrasound transducer, the center operating frequency being at least about 2.9 MHz;

determining at least one of a piezoelectric rugosity (Ra) and piezoelectric waviness (Wa) associated with a piezoelectric material that has a first acoustical impedance;

determining at least one of a dematching Ra and dematching Wa of a dematching material that has a second acoustical impedance, the piezoelectric and dematching materials having an impedance ratio of at least 2; and joining the piezoelectric material and the dematching material with an assembly material to form an acoustical connection there-between, the assembly material having a thickness that is based on at least one of the piezoelectric Ra, piezoelectric Wa, dematching Ra and dematching Wa.

13. The method of claim 12, wherein the piezoelectric Wa and the dematching Wa have associated mean depth values that are less than the thickness of the assembly material.

14. The method of claim 12, wherein the piezoelectric Ra and the dematching Ra have associated mean depth values that are less than the thickness of the assembly material.

15. The method of claim 12, wherein the piezoelectric layer comprises at least one of piezoelectrical material, piezocomposite material, single crystal piezoelectric material and multi-layer piezoelectric materials.

16. The method of claim 12, wherein the dematching layer comprises one of a high impedance material; a Tungsten material; a Tantalum material; a Tungsten Carbide (WC) material; a WC and Cobalt material; a WC, Cobalt and Tantalum Carbide material; a WC, Nickel and Carbide-Molybdenum oxide ($Mo_2C$) material; and a WC, Nickel, Cobalt and Chromium Carbide ($Cr_3C2$) material.

* * * * *